US011458495B2

(12) United States Patent
Ranweiler

(10) Patent No.: US 11,458,495 B2
(45) Date of Patent: Oct. 4, 2022

(54) PAINT SHIELD

(71) Applicant: Anchor Companies, LLC, Nisswa, MN (US)

(72) Inventor: Timothy Ranweiler, Nisswa, MN (US)

(73) Assignee: ANCHOR COMPANIES, LLC, Nisswa, MN (US)

( * ) Notice: Subject to any disclaimer, the term of this patent is extended or adjusted under 35 U.S.C. 154(b) by 0 days.

(21) Appl. No.: 17/475,187

(22) Filed: Sep. 14, 2021

(65) Prior Publication Data

US 2022/0080443 A1 Mar. 17, 2022

Related U.S. Application Data

(60) Provisional application No. 63/078,909, filed on Sep. 16, 2020.

(51) Int. Cl.

| | |
|---|---|
| ***B05B 12/22*** | (2018.01) |
| ***B05B 12/28*** | (2018.01) |
| ***B05C 21/00*** | (2006.01) |

(52) U.S. Cl.

CPC ..... *B05B 12/22* (2018.02); *B05B 12/28* (2018.02); *B05C 21/005* (2013.01)

(58) Field of Classification Search

None

See application file for complete search history.

(56) References Cited

U.S. PATENT DOCUMENTS

| | | | | |
|---|---|---|---|---|
| 2,098,005 | A * | 11/1937 | Holt | B05B 12/28 118/504 |
| 3,380,435 | A * | 4/1968 | Wagner | B05B 12/28 118/505 |
| 4,085,703 | A | 4/1978 | Glowacki | |
| 4,331,716 | A | 5/1982 | Stark | |
| 4,574,731 | A | 3/1986 | Stevens et al. | |
| 5,056,458 | A | 10/1991 | Askeland | |
| 5,354,377 | A | 10/1994 | Jeffrey, Jr. | |

(Continued)

OTHER PUBLICATIONS

"Stiff Aluminum ProShield Spray Shield, 24"×9", 18" handle, hydetools.com. https://hydetools.com/product/24x9-stiff-aluminum-proshield-spray-shield-18-handle/" [Date accessed: Nov. 20, 2019].

*Primary Examiner* — Jethro M. Pence

(74) *Attorney, Agent, or Firm* — Houda El-Jarrah; Bold IP, PLLC

(57) ABSTRACT

Embodiments are disclosed for an apparatus that enables the user to paint a surface and keep the paint focused in the desired area intended to receive the paint and minimize overspray. The disclosed apparatus is a paint shield. The paint shield includes an elongated planar body, a right fin, a left fin, and one or more reinforcing ridges that extend along the planar body. The paint shield can include an attached or attachable handle and the handle can rotate. The user may adjust the angle of the right fin and the left fin to provide additional protection from the side to protect a surface area from receiving any paint and then orient the back surface of the planar body against a surface to be painted. Once the paint shield is positioned, while holding the paint shield using the handle, the user paints the area not covered by the paint shield. The paint shield protects the surface that is covered by the paint shield so that no or minimal paint is deposited on that surface.

17 Claims, 10 Drawing Sheets

(56) References Cited

U.S. PATENT DOCUMENTS

| | | | | |
|---|---|---|---|---|
| 5,429,677 | A | 7/1995 | Brown | |
| 6,358,321 | B1 | 3/2002 | Meyer et al. | |
| 8,191,502 | B1 | 6/2012 | Jackson | |
| 8,651,047 | B1 | 2/2014 | Uri | |
| 2005/0035221 | A1* | 2/2005 | Gathright | B05B 12/28 239/524 |
| 2008/0092810 | A1* | 4/2008 | Kim | B05B 12/36 118/301 |
| 2008/0098956 | A1 | 5/2008 | Serfozo | |
| 2010/0075051 | A1 | 3/2010 | Darling | |
| 2010/0126416 | A1* | 5/2010 | Gringer | B05B 12/28 118/504 |
| 2014/0209019 | A1* | 7/2014 | Ruha | E04F 21/02 164/113 |
| 2014/0311407 | A1 | 10/2014 | Queiroz | |
| 2015/0151326 | A1* | 6/2015 | Tatia | B05B 12/28 118/505 |
| 2017/0189925 | A1* | 7/2017 | O'Brien | B05C 21/005 |
| 2020/0055070 | A1* | 2/2020 | Masalosalo | B05B 12/32 |

* cited by examiner

PAINT SHIELD

CROSS-REFERENCE TO RELATED APPLICATIONS

This application is a non-provisional application which claims priority to U.S. Provisional Patent Application No. 63/078,909 filed on Sep. 16, 2020, which is incorporated by reference in its entirety.

FIELD OF THE DISCLOSURE

This disclosure generally relates to an improved paint shield that can reduce the amount of time needed to prepare a surface prior to painting and reduce the need for touching up and correction of any excess paint or overspray after painting a surface where the user intends for paint to be applied. The paint shield allows the user to protect to a greater extent surface areas that the user does not desire paint to be applied.

BACKGROUND

Painting one's home, business, or other location always involves multiple considerations. When hiring painting professionals, the cost associated with a painting project is usually paramount. Typically, painting can take a great deal of time and effort because painters attempt to prevent overspray from occurring in advance of beginning the painting. Overspray is excess paint which spreads or blows beyond an intended area being sprayed or painted. If the paint being used is a different color than the color in another location, this will be an obvious problem that has to be corrected. Further, in addition to different color considerations, the type of paint may not be intended to be placed on certain materials or structures and therefore painters have to be careful about only applying a certain color and/or type of paint to the intended surface areas while avoiding other areas that need shielding/protecting.

Overspray is especially common when using a paint sprayer to paint a surface rather than using a paint brush or roller, although it is still possible to end up with paint covering an unintended area when using a paint brush or roller. Typically, painters prefer to use paint sprayers for larger areas because the paint is applied faster and more evenly than when using a brush or roller, but the problem remains that overspray is especially common when using paint sprayers, and painters must spend a great deal of time afterwards touching up a painted area to correct overspray errors.

A great deal of preparation time may go into preparing an area prior to painting. For example, painters regularly tape off areas around a target painting area so that if overspray were to occur, the overspray lands on the tape, which can then be easily removed and pulled off, as opposed to having to touch up that area with the original paint color. A great deal of time is devoted to taping and masking off a target paint area in preparation for the substantial painting work, which translates to more cost and expense.

Even when taping off an area to avoid paint splatter or overspray, once the painting is complete, it is still quite common for paint splatter or overspray to have occurred. Typically, hiring professionals who must spend time on a ladder and carefully use a brush to correct and clean up the overspray that occurs on certain areas of an interior surface or exterior surface is also expensive.

The cost and time needed to correct overspray as noted above is of paramount consideration. Paint shields are currently used to attempt to minimize overspray. Some paint shields are small in size while other paint shields are larger in size to accommodate different uses and types of surfaces. Some paint shields are made of cardboard, while others are made of plastic or metal.

However, there are still many deficiencies with existing paint shields. While using a paint shield may assist in minimizing overspray, there are still many areas that will still end up having overspray and will need to be touched up and corrected. Further, conventionally available paint shields typically do not lay straight enough or rigid enough and end up curving or bending easily, which means that the paint is not applied evenly (especially when using a paint sprayer). Accordingly, additional time and expense is required even after using existing paint shields to correct overspray that occurs and clean up any paint located on an unwanted area of a room, house, or other location. Further, existing paint shields are typically only one size and do not have any ability to vary the length of the paint shield. Additionally, commercially available paint shields typically only protect the immediate surface underneath or behind the paint shield and do not protect the exposed surfaces located just beyond the left and right side edges of the paint shield.

Accordingly, there are still multiple deficiencies with the conventionally available paint shields. One or more embodiments disclosed herein may offer an improvement and solutions to the problems described above.

SUMMARY

One or more embodiments are described herein include an improved and enhanced paint shield and system that may correct the deficiencies of conventionally available paint shields. In one non-limiting embodiments, the paint shield includes an elongated planar sheet, at least two ridges on the elongated planar sheet, and at least two fins, whose angle with respect to the elongated sheet may be adjustable. The elongated sheet may include a top edge, a bottom edge, a left side edge, a right side edge, as well as a front and back surface. In a non-limiting embodiment, the elongated sheet may be extendable in the longitudinal direction so that more surface area underlying the elongated sheet may be protected if needed. Two ridges extend longitudinally from one lateral end to another lateral end along the elongated sheet and protrude upwards from the front surface of the elongated planar sheet. The two ridges are spaced apart from one another and may have a distance between each ridge. Additionally, the paint shield includes at least two fins attached or otherwise integrated into the left and right edges of the elongated sheet. The angle at which the fins can move is adjustable over any range of angles including, but not limited to, over a range of 0-180 degrees. Further, if the user desires, the angles of the fins can each be adjusted to be a different angle for each fin.

In another embodiment, the elongated planar sheet may include only one reinforcing ridge extending across the elongated planar sheet as well as a first fin and a second fin, whereby an angle of the first fin and the second fin is adjustable over a range of angles, including, an obtuse angle, a right angle, an acute angle, or a straight angle. The fins may also be replaceable with other fins having other shapes, including curved or beveled edges.

In addition to the above, in a non-limiting embodiment, a removable liner or cover can be attached to one or more surfaces of the elongated sheet and fins of the paint shield.

While in use, the paint shield will likely become covered in paint, and the liner allows the user to remove the liner that is covered in paint and dispose of the liner for easy cleanup. A handle is also separately attachable and can be useful in holding the paint shield in place against a surface. The handle may attach to the elongated planar sheet, such as for example, in the bottom center of the planar sheet along the bottom edge in a non-limiting embodiment. Accordingly, the paint shield may include a handle attachment mechanism and pivot point included on the elongated sheet for the handle to pivot around the pivot point while attached to the elongated sheet of the paint shield. In other embodiments, any type of handle may attach to an elongated sheet (either centrally on a bottom edge of the elongated sheet or another location along the bottom edge) and may not necessarily rotate.

The paint shield is used by positioning the left fin and the right fin of the paint shield to the desired angle before use. Once the fins are in position, the elongated planar sheet may be adjusted to the correct length, if the elongated planar sheet is extendable, so that a desired amount of surface area to be protected from the paint spray is covered by the paint shield. In some embodiments, the elongated planar sheet may not be extendable and may have only one fixed length and width.

To use the paint shield to protect a surface, the paint shield may be placed over a surface, whereby the body of the paint shield, including the angled fins, covers a portion of the surface in which paint should not be applied. The user may hold the paint shield in place with one hand and paint the desired surface with the other hand. Once the area is completely painted, the user removes the paint shield from the surface. There may be a visible difference between an area that has been painted and an area that has been protected by the paint shield and clear lines of demarcation between the two areas. This process may be repeated as many times as necessary to paint the desired surfaces while protecting other surfaces from paint overspray using the paint shield. Advantageously, as disclosed herein, the paint shield includes at least two reinforcing ridges so that the paint shield remains straight and does not bow or cave inward when held flat against a surface. Further, another important benefit of the paint shield as disclosed herein is the inclusion of the adjustable fins on the left and right sides of the elongated sheet.

Other aspects and advantages of the invention will be apparent from the following description and the appended claims.

BRIEF DESCRIPTION OF THE DRAWINGS

The preceding and following embodiments and descriptions are for illustrative purposes only and are not intended to limit the scope of this disclosure. Other aspects and advantages of this disclosure will become apparent from the following detailed description.

Embodiments of the present disclosure are described in detail below with reference to the following drawings. The drawings described herein are for illustrative purposes only of selected embodiments and not all possible implementations and are not intended to limit the scope of the present disclosure.

DETAILED DESCRIPTION

Figure 1:
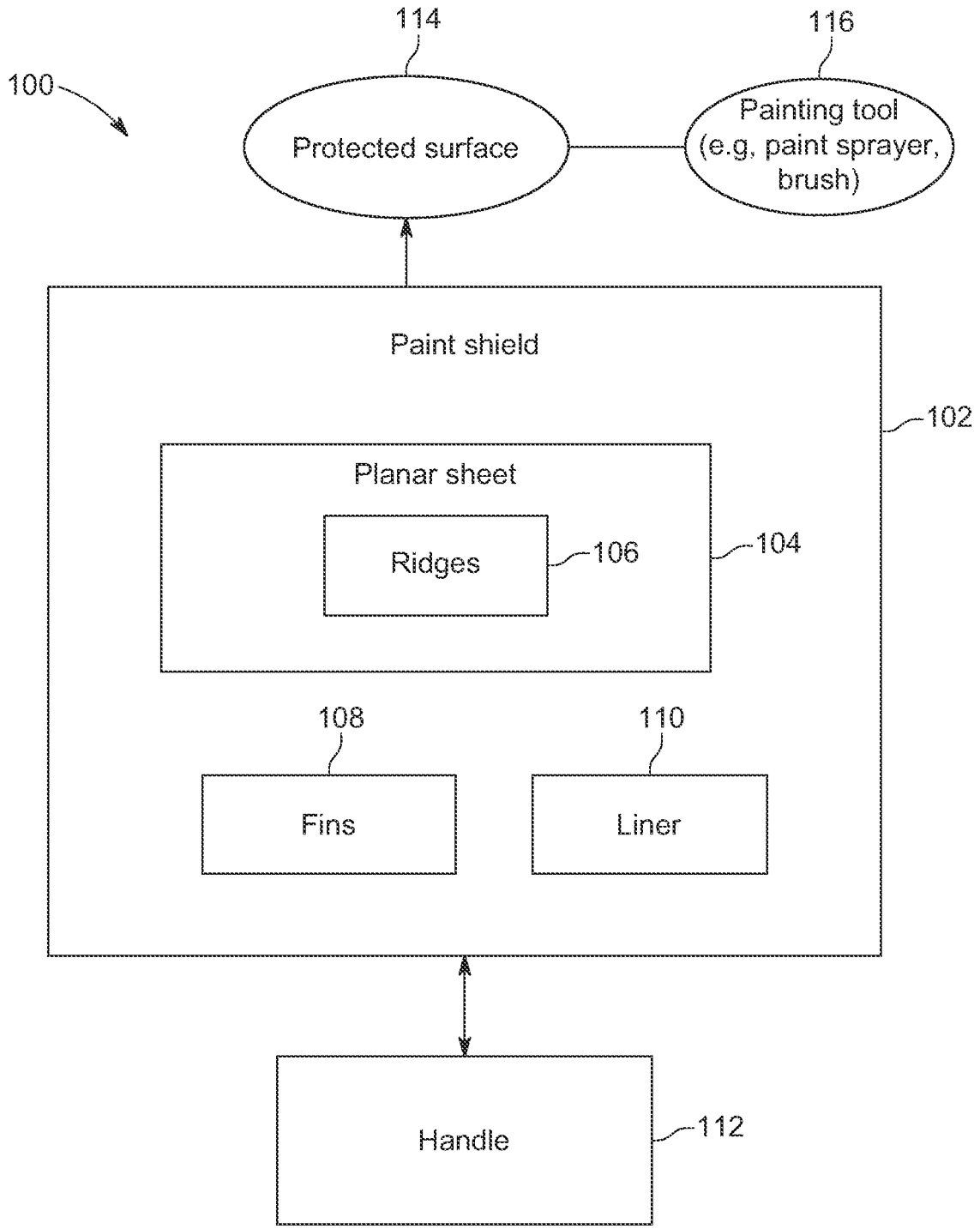
FIG. 1 is a block diagram of a paint shield according to an exemplary embodiment.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with; and/or in the context of other particular aspects and embodiments of the invention; and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

As noted above, considerable time and effort is spent in painting and then preventing and correcting paint splatter or overspray. Painters spend a great deal of time in taping off an area to minimize overspray before substantially painting an area, and also spend a great deal of time cleaning up the area afterwards using brushes and engaging in brushwork to remove the overspray. Currently, in order to fix any paint being accidentally sprayed or applied to a surface where the paint is not meant to be applied, a painter must engage in corrective brushwork whereby the painter carefully and gingerly paints over areas where the overspray occurred and cleaning these surfaces to reflect the paint color and texture that the client requested or intended. All this additional time preparing before a painting project occurs or afterwards to clean up the area is additional expense to the client or customer.

Accordingly, one or more embodiments described herein include an improved and enhanced paint shield and system that may correct the deficiencies of conventionally available paint shields and reduce/avoid entirely corrective brushwork due to overspray or painting onto an unintended surface. In one non-limiting embodiment, a paint shield, as described herein, includes an elongated planar sheet having an adjustable fin located on the left side and the right side of the elongated planar sheet. In one embodiment, the fins may be usefully positioned at a right angle from the elongated sheet. In another embodiment, the angle of the fins from the elongated sheet may be adjusted by a user and range over a variety of angles, such that the fins may be angled at a right angle, an acute angle, an obtuse angle. Further, in one or more non-limiting embodiments, the fins may be configured to extend to a full 180 degree (straight angle) from the elongated sheet, which effectively extends the length of the paint shield. The fins assist in minimizing overspray from occurring beyond the left and right-side edges of the paint shield.

Additionally, in one or more non-limiting embodiments, the elongated planar sheet may include one or more reinforcing structural ridges that extend along the length of the elongated flat sheet of the paint shield. These reinforcing structural ridges may ensure that the paint shield lays flat and straight when in use and minimizes or eliminates bending or curving of the elongated sheet. Further details are provided for an improved paint shield below with respect to the Figures.

FIG. 1 shows a block diagram of the paint shield according to exemplary embodiments. The block diagram outlines the multiple exemplary components of the paint shield 102 as well as attachments and areas in which the paint shield may be placed.

Figure 2A:
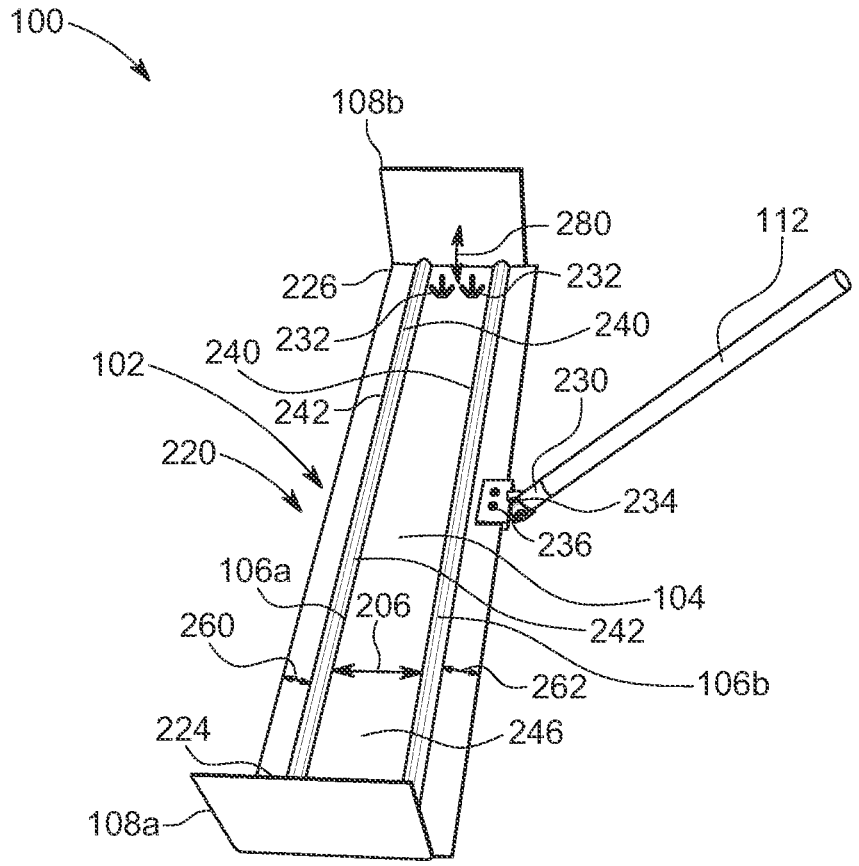
FIG. 2A is a pictorial illustration depicting a front perspective view of an exemplary paint shield in accordance with one or more illustrative embodiments.

Paint shield 102 is a tool or device that may be used when painting a surface. The surface may be an interior or exterior surface of a house, business, or any other type of structure without limitation. Paint shield 102 acts as a protective shield that keeps paint away from certain areas. Paint shield 102 may be used to keep the paint focused in the desired area intended to receive the paint and helps to keep paint off an area where paint is not desired or is unwanted. The user may hold and orient paint shield 102 in such a way so that the structural body of the paint shield can shield certain surfaces from receiving any unwanted paint or overspray. For paint shield 102, the elongated planar sheet 104, the at least two reinforcing ridges 106, and the left and right fins 108*a*, 108*b* (e.g., as shown in FIG. 2A) assist in protecting certain areas of a surface from receiving paint. It is noted that the term "elongated planar sheet" as used herein may interchangeably be referred to as "elongated sheet" or "plate."

In a non-limiting embodiment, the elongated sheet 104 is a long rectangular sheet. The elongated sheet 104 may be used to protect a surface, such as a ceiling, window, or any other area, from paint while a user paints other areas where paint should be applied. In a non-limiting embodiment, at least two reinforcing ridges 106 are integrated into a body of the elongated sheet 104 and extend along the entire length of the elongated sheet 104. In one exemplary embodiment, the at least two reinforcing ridges 106 extrude upwardly out of the front surface (e.g., front surface 246 as shown in FIG. 2A) of the elongated sheet 104 enabling the paint shield 102 to lay flat against a surface when in use. The one or more ridges 106 may assist the elongated sheet 104 to remain flat and straight when pushed up against a surface so that the elongated sheet 104 does not curve or bend. Two ridges 106 in particular may be particularly adept at preventing the elongated sheet 104 from curving or bending.

It is noted in one or more non-limiting embodiments, the paint shield 102 may have only one reinforcing ridge 106 extending across the elongated planar sheet 104 of the paint shield 102, as well as the fins 108 noted below. The single ridge 106 may be located centrally or may be located on a higher or lower portion of the elongated planar sheet 106 and extend across the elongated planar sheet 106 in a longitudinal direction.

In a non-limiting embodiment, fins 108 are attached at both the right and left sides of the elongated sheet 104. The fins 108 are adjustable and may be angled at a right angle, an acute angle, an obtuse angle, or 180 degrees flat along a surface. The fins 108 may assist in containing any paint spray or overspray to the left and right sides of the paint shield so that the paint is applied only to the intended surface and not to the areas shielded by the planar sheet 104 and the fins 108. Further, the fins 108 allow the paint to be sprayed directly up to the edges of the paint shield 102 and provide a cleaner painting result.

In a non-limiting embodiment, the system 100 may further include a liner 110 that may be positioned on or over a full length of the elongated sheet 104 of the paint shield 102. In another embodiment, one or more pieces of the liner 110 may be positioned and attached to one or more surfaces of the fins 108 as well as to one or more surfaces of the elongated sheet 104. The liner 110 may be removeably attached or positioned to the elongated planar sheet 104 and fins 108. Further, the liner 110 may enable easier cleanup of the paint shield. Instead of paint coating and covering the elongated planar sheet 104 and the fins 108, the liner 110 may absorb the paint. Upon completion of painting, the user may remove the liner 110 and dispose of the liner 110 if the liner 110 is disposable. If the liner 110 is reusable, the user may wash the liner 110 for later use. Ultimately, the user spends less time cleaning off paint from the surfaces of the paint shield 102 if the liner 110 is present to absorb the paint and be removed after completion of a painting project or job.

In a non-limiting embodiment, the liner 110 may include an adhesive on a back surface of the liner 110 that enables the liner 110 to adhere to the elongated planar sheet 104 and fins 108. The liner 110 may be made of a material including, but not limited to plastic.

In a non-limiting embodiment, the paint shield 102 may include a handle 112. The handle 112 may be removeably or non-removeably attached to the elongated sheet 104 of the paint shield 102. In a non-limiting embodiment, the handle 112 may be attached to the bottom edge of the planar sheet 104 of the paint shield 102. More specifically, in a non-limiting embodiment, the handle 112 may be centrally located along the bottom edge of the elongated sheet 104, as shown for example in FIGS. 2A-4. In other embodiments, the handle 112 may be attached at one or more points along the bottom edge of the elongated sheet 104, including in a three-way point arrangement similar to a snow rake.

The handle 112 may be useful for holding the paint shield 102 and orienting the paint shield 102 in multiple directions, orientations, and angles against a surface. The handle 112 may be made of any type of material, as known in the art, including but not limited to, metal, wood, plastic, or a combination thereof.

The paint shield 102 is intended to be used to protect a protected surface 114 from unwanted paint or paint spray. A user may use a painting tool 116 to apply or spray paint on a non-protected surface and against the paint shield 102 so that paint is distributed everywhere except on the protected surface 114. When the paint shield 102 is in use, the user will hold the handle 112 of the paint shield 102 and place the rear surface of the elongated sheet 104 of the paint shield 102 against the protected surface 114. The protected surface 114 will not get paint on the surface while the paint shield 102 is in place against the surface.

The painting tool 116 may be any type of tool useful for applying paint. In a non-limiting embodiment, the painting tool 116 may be a paint sprayer. As known in the art, paint sprayers are tools that can apply paint at a faster rate as compared with traditional brushes and rollers. The paint sprayers used may be either an airless paint sprayer or may be driven by air in one or more embodiments. The paint shield 102 may also be used with paint brushes, rollers, or other types of painting tools 116 other than paint sprayers.

Figure 5A:
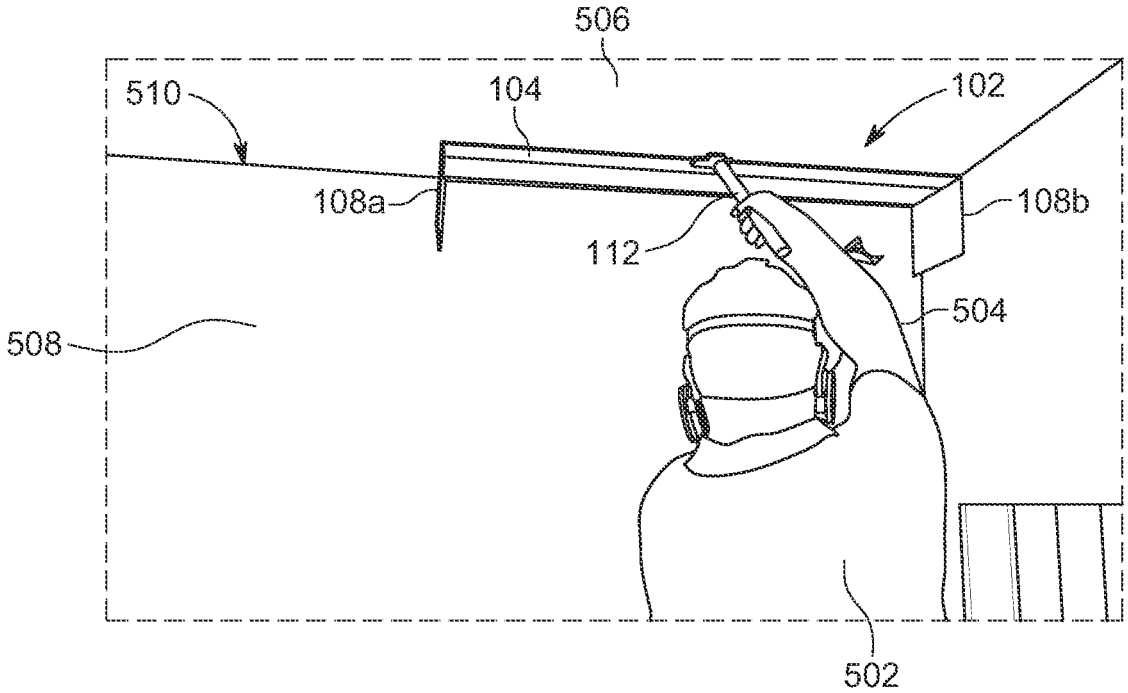
FIG. 5A is a pictorial illustration depicting an exemplary use of the paint shield whereby the paint shield is placed against a wall at the intersection of the wall and ceiling.
Figure 5B:
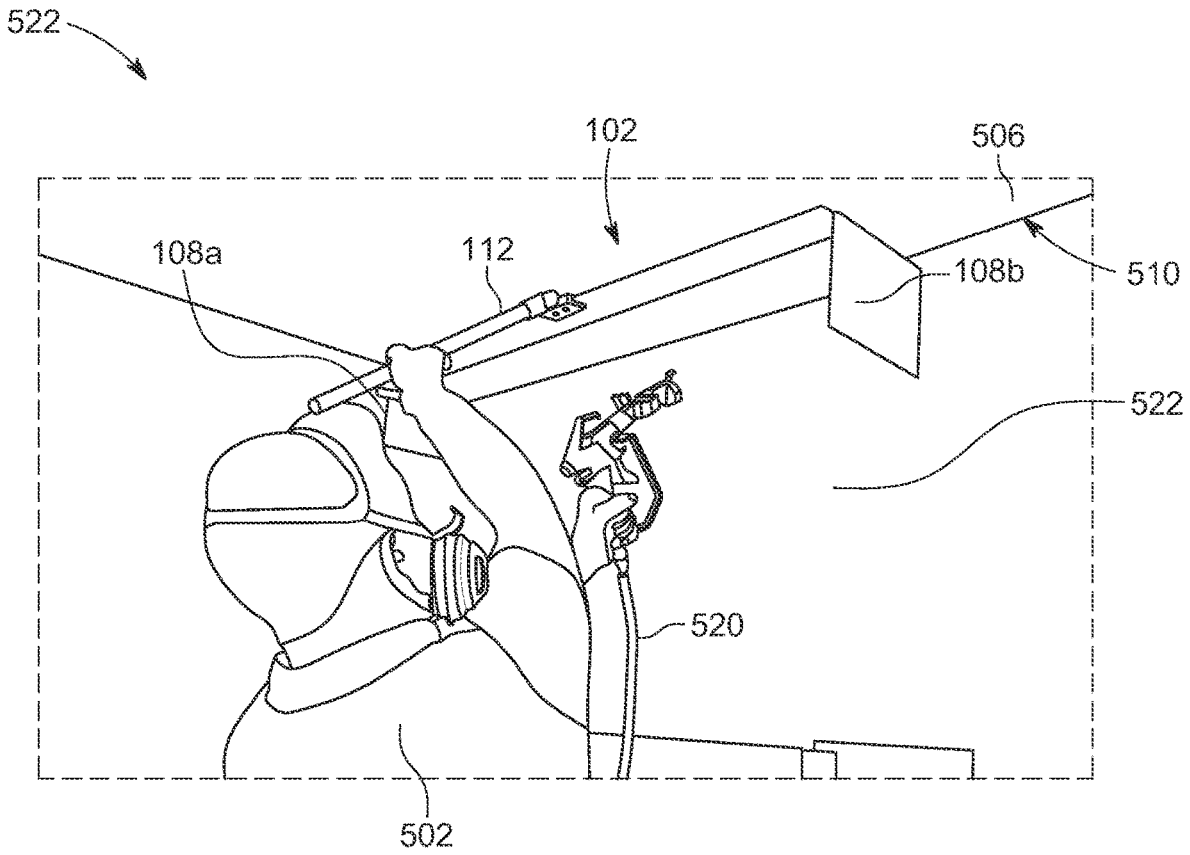
FIG. 5B is a pictorial illustration further depicting the exemplary use of the paint shield after having been moved to an adjacent wall.

In a non-limiting embodiment, there may also be a skid resistant backing on one or more portions of the rear surface 448. The skid resistant backing would help the paint shield be slip resistant when the user is holding the paint shield against the protected surface 114 (e.g., as shown in FIG. 5A-5B). The skid resistant backing may cover the entire rear surface 448 or only one or two portions of the rear surface 448 of the paint shield, including on the undersides 450 of the fins 108. The skid resistant backing may include rubber or another skid resistant material.

Figure 2B:
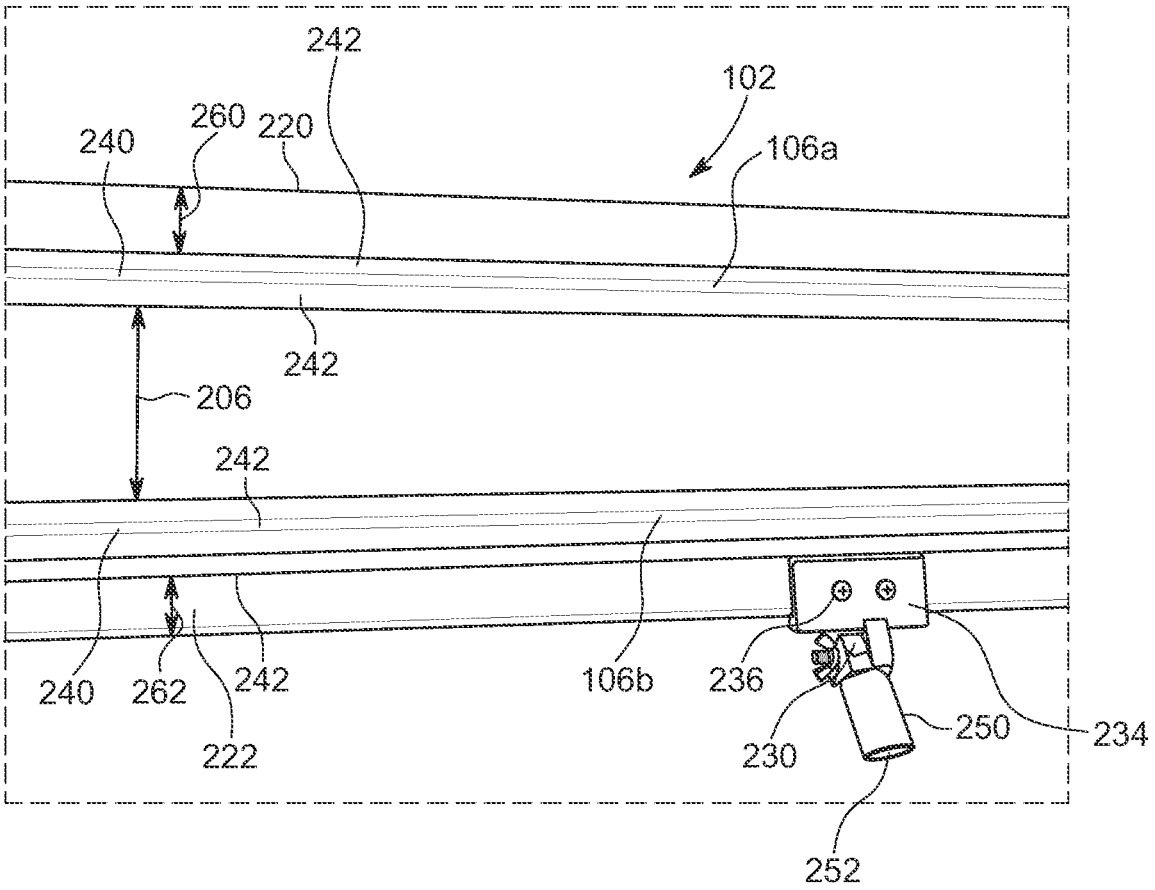
FIG. 2B is a pictorial illustration depicting a front perspective close-up view of the paint shield having at least two ridges and a handle attachment.
Figure 3:
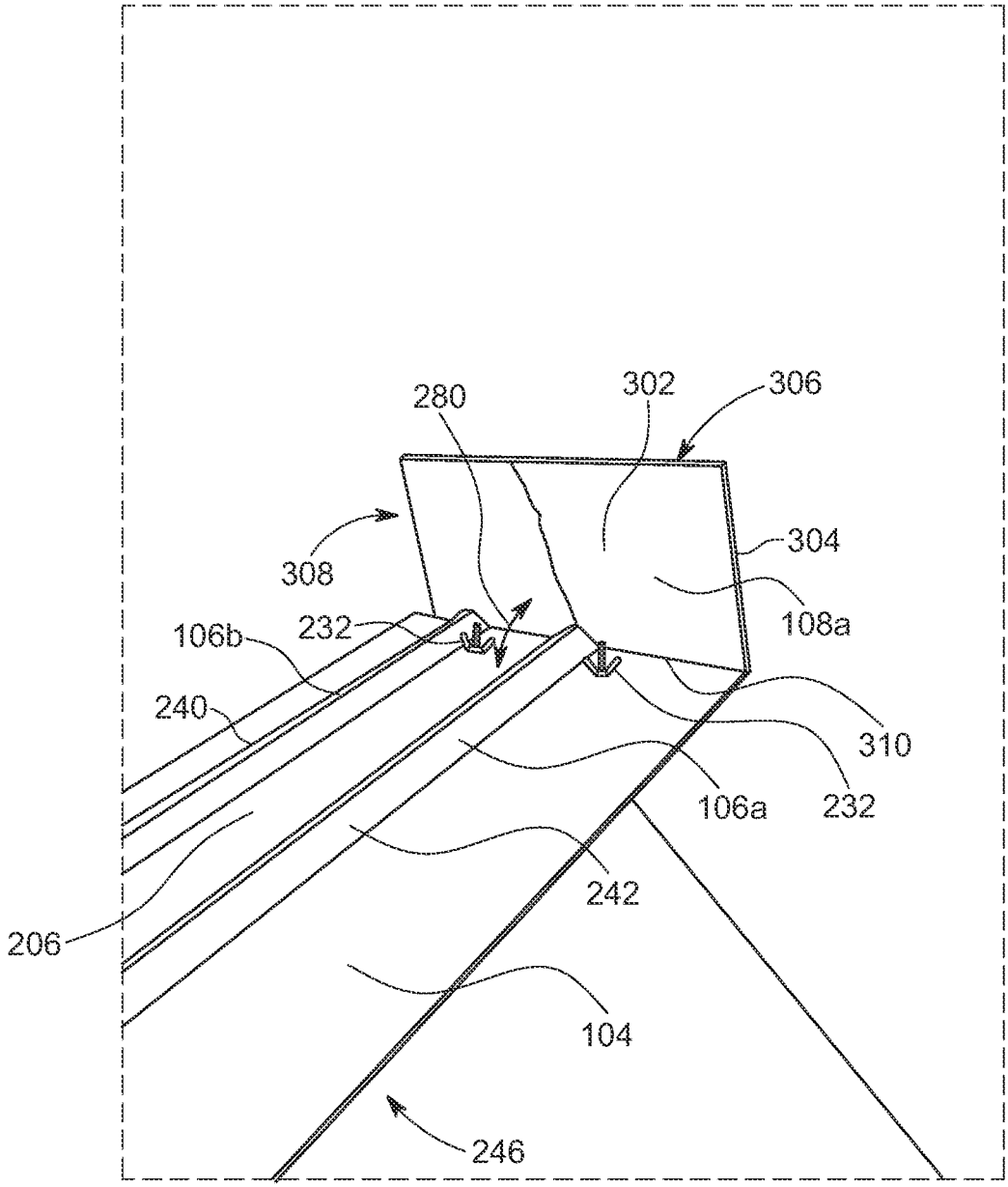
FIG. 3 is a pictorial illustration depicting a front perspective close-up view of the fins and ridges coupled to or located on the elongated sheet of the paint shield.
Figure 4:
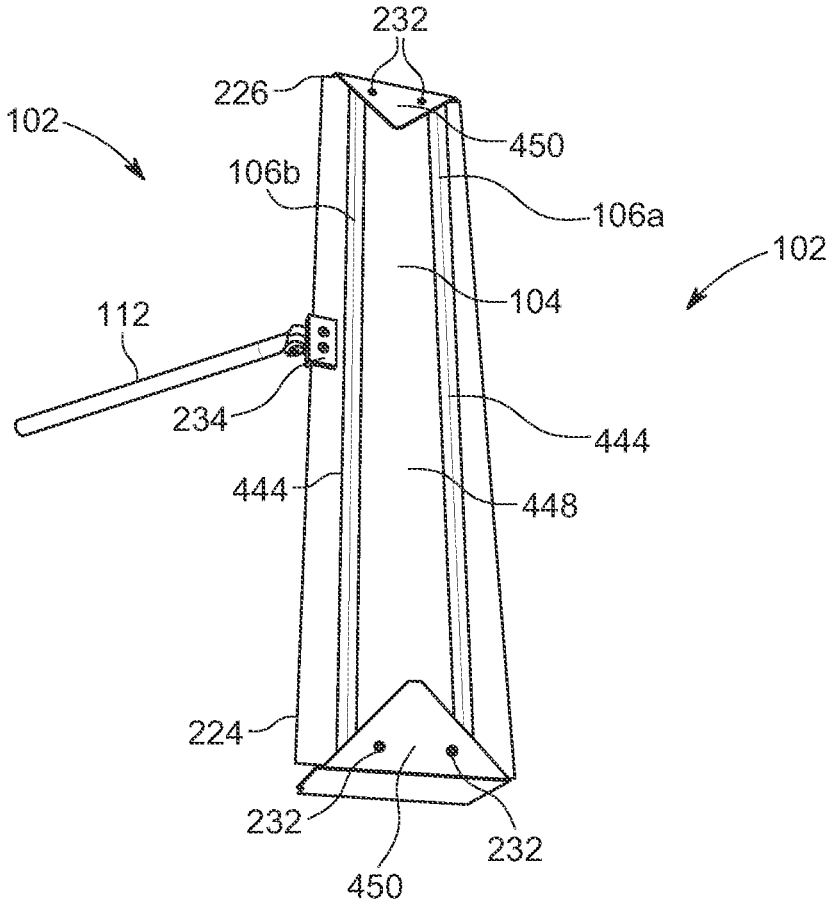
FIG. 4 is a pictorial illustration depicting a rear perspective view of the paint shield.

Turning to FIGS. 2A-4, FIG. 2A shows a front perspective pictorial illustration of the front surface 246 of the paint shield 102. FIG. 2B shows a close-up front view of the center of the front surface 246 paint shield 102, ridges 106, and handle attachment piece 234. FIG. 3 shows a close-up front view of the fins 108 and ridges 106 coupled to or located on the elongated sheet 104. FIG. 4 shows a rear perspective view of the paint shield 102 according to one or more non-limiting embodiments. As shown in FIGS. 2A-4, in one or more non-limiting embodiments, the paint shield system 100 may include a paint shield 102 that includes an elongated sheet 104, a first fin 108*a*, a second fin 108*b*, a top ridge 106*a*, and a bottom ridge 106*b*, which are further described below.

In one or more non-limiting embodiments, as shown in FIG. 2A, paint shield 102 may include an elongated sheet 104. The elongated sheet 104 may generally be a flat, level sheet that extends in a longitudinal direction. The elongated sheet 104 includes a top edge 220, a bottom edge 222 (e.g., as shown in FIG. 2B), a left side edge 224, and a right side edge 226. The elongated sheet 104 may generally be rectangular shaped in one or more non-limiting embodiments, although other shapes and designs may also be available in alternative embodiments.

In one or more non-limiting embodiments, the elongated sheet 104 may include at least two ridges, namely, top rib 106*a* and bottom ridge 106*b* as shown in FIG. 2A. The top ridge 106*a* and bottom ridge 106*b* may function as reinforcing structural elements for the elongated sheet 104. The ridges 106*a,b* assist in keeping the elongated sheet 104 straight and level and prevent the elongated sheet 104 from bending or curving. Advantageously, paint shield 102 includes two ridges 106*a* and 106*b*. The addition of the second top ridge 106*a* to the elongated sheet 104 assists in keeping the elongated sheet 104 of the paint shield 102 flat and straight when pressed against a surface.

FIGS. 2B and 3 show a front perspective close-up view of the top ridge 106*a* and the bottom ridge 106*b*, and FIG. 3 shows the first fin 108*a*. As shown in FIGS. 2B and 3, the top ridge 106*a* and the bottom ridge 106*b* may include angled wall surfaces 242, as shown in FIGS. 2A and 2B, that angle or slope upwardly from the front facing lower surface 246 of the elongated sheet 104. The angled wall surfaces 242 may slope upwards to a top portion 240 of the top ridge 106*a* and of the bottom ridge 106*b*. In a non-limiting embodiment, the ridges 106*a*, 106*b* may angle upwardly from the front surface 246 of the elongated sheet 104 to a flattened top portion 240. In other embodiments, the ridges 106*a*, 106*b* may angle upwardly from the front surface 246 to a curved top portion 240. Accordingly, the ridges 106*a*, 106*b* may have a generally upside down "V" shaped appearance if the top portion 240 of the ridges 106*a*,106*b* is sharper and more pointed. Alternatively, the ridges 106*a*, 106*b* may have a generally upside down "U" shaped appearance and have a more curved, rounded form.

In one or more non-limiting embodiments, the top ridge 106*a* and the bottom ridge 106*b* may be integrally formed with the elongated sheet 104. Alternatively, the top ridge 106*a* and the bottom ridge 106*b* may be separately formed or manufactured to be a part of the elongated sheet 104.

FIG. 4 shows a view of the back or rear surface 448 of the paint shield 102. As shown in FIG. 4, the top ridge 106*a* and the bottom ridge 106*b* may further include recessed grooves 444 that recede into the rear surface 448 of the elongated sheet 104. As noted above, because the ridges 106*a*, 106*b* protrude upwardly from the front surface of the elongated sheet 104, the grooves 444 on the rear 448 or underside of the elongated sheet 104 naturally recede into the rear surface 448 of the elongated sheet 104.

As noted above, the top ridge 106*a* and the bottom ridge 106*b* function to make the elongated sheet 104 more structurally sound. Further, the top ridge 106*a* and the bottom ridge 106*b* may act as a runoff edge that collects paint so as to prevent the paint that is sprayed by the user using a paint sprayer or applied to a surface above or below the paint shield 102 from dripping in an undesirable manner onto the surface that is to be painted. While FIGS. 2A-4 show two ridges (e.g., top ridge 106*a* and bottom ridge 106*b*), in other embodiments, there may be more than two ridges, including three or four or five ridges. Further, the ridges 106 may have a different configuration and design than the configuration and design shown in FIGS. 2A-4.

In a non-limiting embodiment, there may be a distance 260 between the top edge 220 of the elongated sheet 104 and the top ridge 106*a* as shown in FIGS. 2A and 2B. Further, there may be another distance 262 between the bottom edge 222 of the elongated sheet 104 and the bottom ridge 106*b* of the elongated sheet 104. Further, there may be another distance 206 between the top ridge 106*a* and the bottom ridge 106*b*.

In a non-limiting embodiment, a length of the paint shield 102 from the top edge 220 to the bottom edge 222 may be approximately 9 inches long. A width of the paint shield 102, in a non-limiting embodiment, extending from the left edge 224 to the right edge 226 may be approximately 30 inches wide, although the paint shield 102 may be manufactured having other widths as well. For example, in other embodiments, various paint shields may be manufactured having a width of 42 inches, 48 inches, or 72 inches. Further, in a non-limiting embodiment, the distance 206 between the top ridge 106*a* and the bottom ridge 106*b* may be approximately 4 inches.

In one or more non-limiting embodiments, the paint shield 102 may further include a first fin 108*a* and a second fin 108*b* as shown in FIGS. 2A-4. The first fin 108*a* may be attached to the left side edge 224 of the elongated sheet 104 of the paint shield 102. The second fin 108*b* may be attached to the right side edge 226 of the elongated sheet 104 of the paint shield 102. In one or more non-limiting embodiments, the first fin 108*a* and the second fin 108*b* may be attached to the left side edge 224 and the right side edge 226 of the elongated sheet 104 using fasteners 232 (e.g. as shown in FIGS. 2A and 3). In one or more non-limiting embodiments, fasteners 232 may include a bolt or screw and wing nuts to fasten the bolt or screw into place. Any type of fastener other than bolts or screws may alternatively be used, including, but not limited to snaps, clasps, or other fasteners known in the art. Other means of attachment may also be used including via VELCRO, magnets, or any other means of attachment known in the art.

In one or more non-limiting embodiments, the first fin 108*a* and the second fin 108*b* may be initially configured to extend upwardly and away from the front surface 246 of the elongated sheet 104. Further, in one configuration, the first fin 108*a* and the second fin 108*b* may be oriented at a right angle with respect to the front surface 246 of the elongated sheet 104. Angle 280 as shown in FIG. 2A and FIG. 3 is illustrated to show that this angle 280 may be adjustable by the user for each fin 108*a*,108*b* to the desired angle suitable for use for any particular paint project to shield an area from paint.

The first fin 108*a* and the second fin 108*b* may be configured to prevent paint from being applied to any areas located beneath or adjacent to the first fin 108*a* and the second fin 108*b*. When a painter is spraying paint using a paint sprayer or using another paint tool 116, the paint may be directed to the desired surface where the paint is intended to be applied when using paint shield 102. Advantageously, any overspray or excess paint may end up coating the elongated sheet 104 of the paint shield 102 and the surface areas intended to receive paint while the protected surface 114 is kept clean from unwanted paint. The overspray or excess paint may also end up coating the first fin 108*a* and the second fin 108*b* thereby avoiding coating the protected surface 114 where the paint is not desired to be applied or sprayed. Paint shield 102 is an improvement over conventional paint shields because of the inclusion of first fin 108*a* and second fin 108*b*. Having paint shield 102 with the additional first fin 108*a* and second fin 108*b*, as well as the reinforcing top ridge 106*a* and the bottom ridge 106*b* may save a painter a great deal of time and a great deal of cost to the client by minimizing or preventing any overspray from occurring.

In one or more non-limiting embodiments, first fin 108*a* and second fin 108*b* may be removably attached to the elongated sheet 104 using fasteners, such as fasteners 232 shown in FIGS. 2A and 3. FIG. 3 may show a close-up view of first fin 108*a*. First fin 108*a* may include the same components as second fin 108*b* in one or more non-limiting embodiments. As shown in FIG. 3, each fin 108*a* and 108*b* includes a body such as main body 302. In one or more non-limiting embodiments, the body 302 of the fins 108*a*, 108*b* is generally rectangular shaped with three exterior facing, straight edges, such as edges 304, 306, and 308 as shown in FIG. 3. Further, as also shown in FIG. 3, each fin 108*a*, 108*b* has a joining edge 310 that joins and connects to the lateral edges and left side 224 and right side 226 (e.g., as shown in FIG. 2A) of the elongated sheet 104. In one embodiment, the fins 108*a*, 108*b* may have straight edges. In other embodiments, the fins 108*a*, 108*b* may have beveled edges that may be useful when oriented against surfaces cut at a same bevel angle. For example, if the paint shield 102 is being used while painting siding on a home or other location having a beveled edge, it may be useful for the fins 108*a*, 108*b* to also include the same beveled edges to best fit the painting project.

Accordingly, in one or more non-limiting embodiments, the fins 108*a*, 108*b* may be removable and the user may replace the original set of fins 108*a*, 108*b* with other fins 108*a*, 108*b* having different shapes and/or sizes. As noted above, the fins 108*a*, 108*b* shown in FIGS. 2A-4 are rectangular shaped with straight edges. A user may desire to replace this set of fins 108*a*, 108*b* with alternative fins 108*a*, 108*b* that can be attached to the elongated planar sheet 104 using fasteners 232, whereby the new set of fins 108*a*, 108*b* are beveled and/or curved to better suit a different painting project. Accordingly, the fins 108*a*, 108*b* may be reconfigurable and the user has the option to purchase other designs of fins 108*a*, 108*b* configured to attach to the paint shield 102's elongated sheet 104.

As shown in FIG. 4, the bottom surfaces 450 of the first fin 108*a* and of the second fin 108*b* may be attached to the rear surface 448 of the elongated sheet 104. In one non-limiting embodiment, the bottom surfaces 450 of the first fin 108*a* and of the second fin 108*b* may be generally triangular shaped, although in other embodiments, any alternative shape or design may be used instead. The bottom surfaces 450 of the first fin 108*a* and second fin 108*b* may include bores for the fasteners 232 to extend through the rear surface 448 of the elongated sheet 104 and to the front surface 246 (e.g., as shown in FIG. 2A) of the elongated sheet 104.

In one or more non-limiting embodiments, the fasteners 232 may include a plastic coating or other protective covering that may be replaceable or easily cleaned in order to prevent any paint building up from coating or covering the fasteners 232. Alternatively, in other embodiments, other materials may be used to cover the fasteners 232 (other than plastic) in order to minimize or prevent paint build up from covering the fasteners 232. Further, it may be advantageous to cover the fasteners 232 with a liner 110 made of plastic or other material in order to avoid the fasteners 232 scratching or leaving marks on the underlying surface of a structure that is to be painted.

Accordingly, the first fin 108*a* and the second fin 108*b* may be manufactured having the rectangular shaped body 302 with the three exterior straight edges 304, 306, and 308 (e.g., as shown in FIG. 3) and may be joined with a bottom piece 450 that folds under the lateral edges 224 and 226 of the elongated sheet 104. As noted above, the bottom pieces 450 of the fins 108*a*, 108*b* may be secured with fasteners 232 into the body of the elongated sheet 104 of the paint shield 102. This is one way in which the first fin 108*a* and the second fin 108*b* may be attached to the elongated sheet 104. In other embodiments, the first fin 108*a* and the second fin 108*b* may be molded and integrally formed with the elongated sheet 104.

In one or more non-limiting embodiments, the body 302 of the first fin 108*a* and the body of the second fin 108*b* may be integrally manufactured and formed with the bottom triangular shaped pieces 450 of the fins 108*a*, 108*b* as a single unit. Alternatively, in other embodiments, the bottom pieces 450 may be separately made and coupled to the body of the first fin 108*a* and the second fin 108*b*. In FIGS. 2A, 3, and 4, the first fin 108*a* and the second fin 108*b* have a body 302 that is folded at a right angle and the bottom pieces 450 are fastened to the rear surface 448 of the elongated sheet 104.

The first fin 108*a* and the second fin 108*b* may be made to have a different shape and design in alternative embodiments than that shown in FIGS. 2A, 3, and 4. For example, the main body 302 of each fin 108*a*, 108*b* may be shaped having a curved shape rather than a straight rectangular shape. Accordingly, the edges 304, 306, 308 of each fin 108*a*, 108*b* may be curved rather than straight as shown in FIGS. 2A, 3, and 4. Such an embodiment in which the fins 108*a*, 108*b* have a curved appearance may be more useful for using on surfaces that curve and angle (e.g. certain trims and sidings for exterior parts of a house or other location), rather than the straight, rectangular edges 304, 306, 308 shown in FIGS. 2A, 3, and 4. The fins 108*a*, 108*b* may have any other shape or design, including having a triangular or circular design or any other configuration without limitation.

The fins 108*a* and 108*b* may be provided to adjust to multiple angle orientations. Alternatively, the fins 108*a* and 108*b* may be purchased already set at specific angles (e.g., right angle, obtuse angle, 180 degrees) and the user may remove and attach fins 108*a*, 108*b* set at desired angles prior to use. In one or more non-limiting embodiments, the first fin 108*a* and the second fin 108*b* may be detachable and replaceable. Accordingly, as noted above, the first fin 108*a* and the second fin 108*b* may be separately purchased and replaced as needed by the user, for example, if the first fin 108*a* or the second fin 108*b* should become damaged. It is noted that in some embodiments, the first fin 108*a* and the second fin 108*b* may not be detachably attached to the elongated sheet 104. Rather, the first fin 108*a* and the second fin 108*b* may be manufactured to be permanently attached to the elongated sheet 104 of the paint shield 102 and thus may not be replaceable.

As noted above, in one embodiment, the first fin 108*a* and the second fin 108*b* may be oriented or positioned at a right angle (e.g., generally 90 degrees) from the horizontal front surface 246 of the elongated sheet 104. In other embodiments, the first fin 108*a* and the second fin 108*b* may be capable of being moved or positioned over a range of angles, such that the user can adjust the angle of the first fin 108*a* and the second fin 108*b*. Accordingly, the first fin 108*a* and the second fin 108*b* in one or more non-limiting embodiments, may be positioned by the user at an acute angle (less than 90 degrees), at an obtuse angle (greater than 90 degrees), as well as at a right angle (at 90 degrees). In one or more non-limiting embodiments, the first fin 108*a* and the second fin 108*b* may be configured to extend fully to a 180-degree angle from the horizontal front surface 146 of the elongated sheet 104. By extending the first fin 108*a* and the second fin 108*b* to a full 180 degrees, the length of the paint shield 102 is effectively extended and provides the user with additional flexibility in using paint shield 102.

In one or more non-limiting embodiments, the elongated sheet 104 may also be extendable from an original length. Accordingly, the elongated sheet 104 may include telescopic sections that can extend and retract in order to alter a length of the elongated sheet 104. This additional feature may enable the user to extend the elongated sheet 104 over a range of lengths which may be beneficial, as in some projects, the user may benefit from paint shield 102 having one overall length and, in another project, the user may require another length. As noted above, the fins 108*a*, 108*b* may also be configured to extend to 180 degrees from the horizontal front surface 246 of the elongated sheet 104, which may further provide additional surface area for the paint shield 102 in a longitudinal direction.

The elongated sheet 104 shown in FIGS. 2A-5B may have a minimum length of 30 inches, although one of ordinary skill will appreciate that the elongated sheet 104 may be shorter than this dimension. The elongated sheet 104 may be manufactured having multiple sizes and lengths, including but not limited to, a length of 42 inches, 48 inches, and 72 inches in alternative embodiments. If the elongated sheet 104 is extendable, the user may extend the elongated sheet 104 to any length desired. For example, it may be beneficial for the elongated sheet 104 to be extendable up to 10 or 12 feet in some instances and the users may hold up the paint shield 102 to cover a maximum distance. This is just exemplary as the paint shield 102 may extend over any range of lengths as desired.

In one or more non-limiting embodiments, it may be preferable the elongated sheet 104 has a relatively thin thickness. In one non-limiting embodiment, the elongated sheet 104 may have a thickness less than $1/8^{th}$ of an inch. In one or more preferred embodiments, the elongated sheet 104 may have a thickness of about $1/16^{th}$ inches. One of ordinary skill in the art understands that these dimensions are exemplary and that the elongated sheet 104 may be thicker or thinner in alternative embodiments. Further, the first fin 108*a* and the second fin 108*b* may also have a relatively thin thickness.

It may be preferable for the elongated sheet 104, the first fin 108*a*, and the second fin 108*b* to be made of metal. Any metal known in the art may be used, including, but not limited to steel. In alternative embodiments, other materials may be used to manufacture the elongated sheet 104, the first fin 108*a*, and the second fin 108*b*, including, but not limited to, plastic, cardboard, wood, glass, or any combination thereof. It is noted that is preferable to use a strong and durable material that does not bend or crown easily (e.g., such as metal) and that may remain as straight as possible when the user is holding the paint shield against a surface to be painted.

It may also be preferable for the paint shield 102 to be made of metal so that it can be magnetically attached to a paint bucket or other magnetically attractive object that painters commonly carry while working. Accordingly, one or more magnets (not shown) may be attached to any part of the paint shield 102, including the handle 112, and or handle attachment mechanism 234, and then attached to a paint bucket or other object.

In one or more non-limiting embodiments, a handle, such as handle 112 (e.g., as shown in FIGS. 2A and 4) may be configured to attach to the elongated sheet 104. The handle 112 may be detachably attached to the paint shield 102 in one or more non-limiting embodiments. In a non-limiting embodiment, the handle 112 may include a handle attachment piece 234 that includes fasteners 236 for attaching the handle 112 to the paint shield 102. The handle 112 may be attached by inserting a suitably sized handle 112 through the handle opening 250 for the handle attachment piece 234 (e.g., as shown in FIG. 2B). The handle 112, as shown in FIGS. 2A and 4, may pivot about a pivot point 230, as also shown in FIG. 2B, and thus allow the user to manipulate and turn the paint shield 102 to various angles and orientations while being attached to the handle 112. In some embodiments, the handle 112 may include a magnet as discussed above in order for the handle 112 while attached to the paint shield 102 to be magnetically coupled to a paint bucket or other magnetically attractive object that a painter may carry, such as a brush.

Additionally, in some non-limiting embodiments, the handle 112 may have a fixed length, but in alternative embodiments, the handle 112 may be extendable so that the lengths of the handle 112 may vary. This may help the user who needs to hold the paint shield 102 closer to the user in some cases, but who may want to extend the paint shield 102 out much farther in other cases. The handle 112 may thus be designed to telescope and extend and retract over a range of lengths to make the handle 112 shorter or longer while attached (whether permanently or removably) to the elongated planer sheet 104 of the paint shield 102.

It is noted that the handle 112 shown in FIGS. 2A and 4 is a non-limiting embodiment. In other embodiments, a paint shield 102 may be separately attachable to any type of handle 112 desired by the user, even a handle 112 that does not pivot or rotate. Further, the paint shield 102 may be separately sold from a handle. For example, a user may use a paint shield holder (not shown) as known in the art that has grips that can open and close. The user may thus slide or otherwise place the paint shield 102 in between the openable grips of the handle 112 or holder and remove the paint shield 102 when completed with a painting project or job.

It is quite common that a paint shield, such as paint shield 102, may become covered with paint. It is possible to clean the surface of the paint shield 102 using a cleaning tool such as a squeegee to clean the surface of the paint shield 102. The squeegee is a cleaning tool that includes either a rubber or cloth end and a handle. The squeegee can be used to wipe and clean off any excess paint off any surface of the paint shield 102. Of course, a user may also use rags, cloths, or any other item to clean off the surfaces of the paint shield 102.

If the paint shield 102 does become coated with paint, the user may wait for the paint shield 102 to fully dry before using the paint shield 102 again in order to avoid having an unwanted paint color dripping onto an underlying surface having a different paint color. In the embodiment that includes a disposable paint shield liner 110, the user may simply and easily apply the paint shield liner 110 and remove when the paint shield liner 110 becomes saturated with paint. The underlying surface of the paint shield 102 should be clean and not include paint, which means the user may save time waiting for the paint shield 102 to dry or cleaning the paint shield 102. In one or more non-limiting embodiments, the underside of the paint shield cover or liner 110 may include a sticky adhesive that can easily stick to the surfaces of the paint shield 102, and that can also be removed when no longer needed. In other embodiments, the paint shield cover 102 may use Velcro to detachably attach to the surfaces of the paint shield 102. Alternative methods of attachment of a paint shield cover or liner may also be used. It is also noted that in some embodiments, the paint shield cover or liner 110 may not be disposable. Rather, the paint shield cover or liner 110 may be washable and reusable.

FIGS. 5A-5B are pictorial illustrations that may assist in illustrating a method of use of the paint shield 102. In FIGS. 5A and 5B, the elongated sheet 104 of the paint shield 102 is placed at the joint 510 between a ceiling 506 and a wall 508. It is noted that this is an exemplary use and the paint shield 102 may be used in any interior or exterior environment, whether residential or commercial, in any location other than the example shown in FIGS. 5A-5B.

FIG. 5A shows the user 502 may be holding the paint shield 102 via the attached handle 112. A user 502 may be holding the paint shield 102 on a floor surface or may be standing on a raised ladder or other elevated position in one or more embodiments in order to be able to adequately reach a desired location needing painting. The handle 112 may help the user position the paint shield 102 as needed and hold the paint shield 102 farther away if needed. Further, FIG. 5B further shows that the user 502 may be holding a painting tool 116 such as a paint sprayer 520 to paint the intended surfaces (although other painting tools 116 may be used as noted above, including brushes or rollers).

As shown in FIG. 5A, the user may position the paint shield 102 by orienting the paint shield 102 such that the rear surface 448, as shown in FIG. 4, is positioned against the surface to be protected. The user 502 may use the handle 112 to manipulate and orient a position and orientation of the paint shield 102. In the example shown in FIG. 5A, the paint shield 102 is placed flat against the ceiling 506 and the fins 108*a*,108*b* are angled at 90 degrees. In this case, the fins 108*a*,108*b* are pointing away from the surface to be protected (e.g., protected surface 114), which in this case is the ceiling 506.

As noted above, the angles of the fins 108*a*,108*b* with respect to the elongated sheet 104 are adjustable. The user 502 of the paint shield 102 holds the handle 112 of the paint shield 102 with their arm 504. The arm that is not holding the handle 112 of the paint shield 102 holds the painting device 520, as shown in FIG. 5B. The user 502 paints the wall 508 around the paint shield and the ceiling 506 and other areas where the paint shield is located is protected from any unwanted paint (e.g., protected surface 114 as shown in FIG. 1). Advantageously, the user 502 can paint directly up to the edges of the fins 108*a*, 108*b* and the elongated sheet 104 to apply any paint to the intended areas.

To use the paint shield 102, the user may take hold and grasp handle 112 shown in FIG. 2A, FIG. 4, and FIGS. 5A-5B. Alternatively, if the paint shield 102 is not already connected to handle 112, the user may insert the paint shield 102 into a paint shield holder (not shown) as known by one of ordinary skill in the art by sliding the lower edge 222 of the elongated sheet 104 into the paint shield holder. This way the user may alternate paint shield holders and use different sized paint shields 102 as needed.

Accordingly, the user should position the paint shield 102 such that the front surface 246 of the elongated sheet 104 is facing the user and the rear surface 448 of the elongated sheet 104 is pressed against a surface, such as a wall or window or any other type of structure. The user has the flexibility to hold and orient the paint shield 102 so that the paint shield 102 is either held horizontally or held vertically against a painting surface as long as the front surface 246 of the elongated sheet 104 is facing the user and visible to the user.

Paint shield 102 may be oriented horizontally or vertically to suit the painter's needs. For example, if a painter is holding the paint shield 102 against a windowpane, and painting the trim around the windowpane, it may be preferable to hold the paint shield 102 vertically so that any overspray hits the surface of the paint shield 102 and not the windowpane.

If the user is using the paint shield 102 to paint the soffit and fascia on a house or other property, the user may want to orient the paint shield 102 above the user's head but in a horizontal direction in order to avoid overspray hitting the soffit and fascia in undesirable locations. The soffit is part of the overhang where one's roof meets the siding, and the fascia is the board along the side of the overhang and the roof that helps the roof appear finished.

Figure 8:
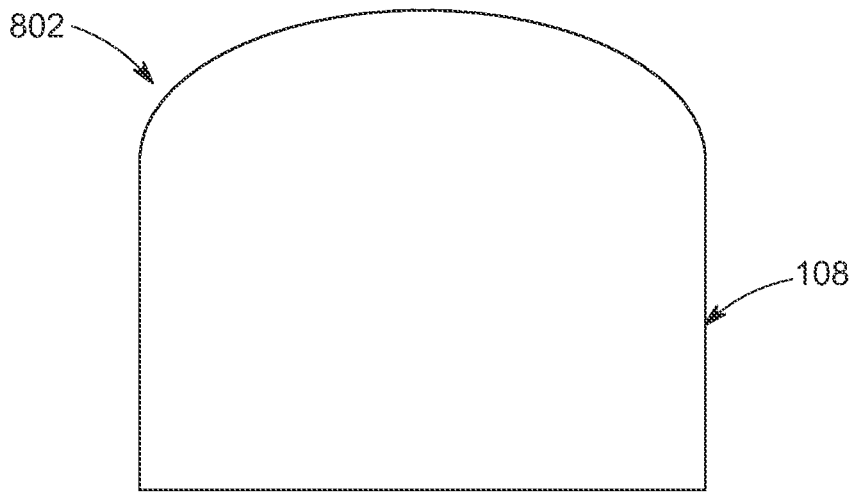
FIG. 8 depicts a pictorial illustration of an example fin having a curved edge.
Figure 9:
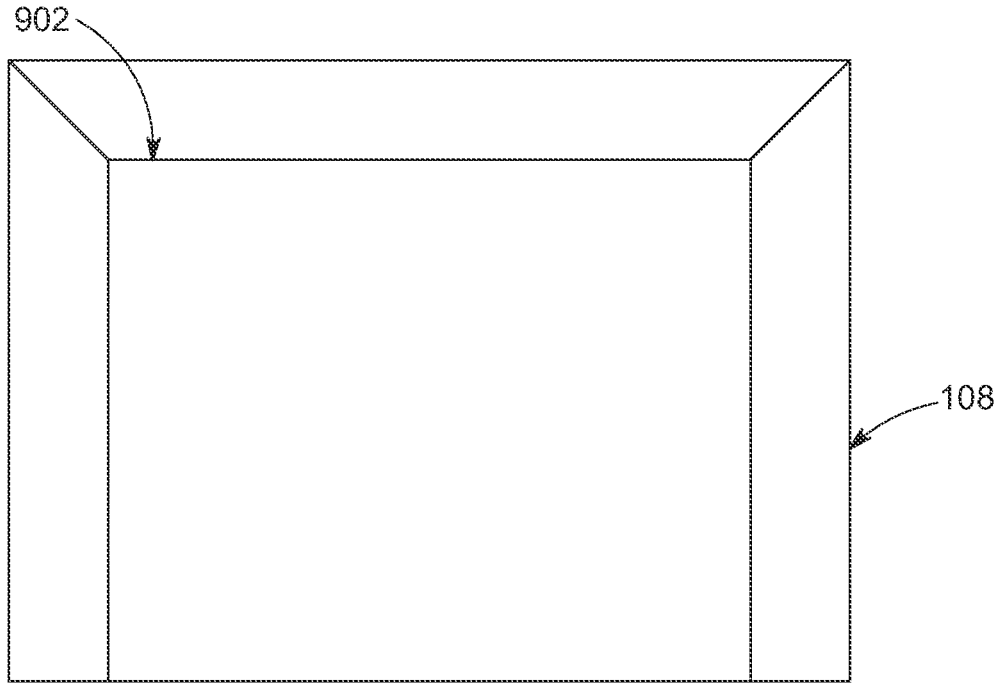
FIG. 9 depicts a pictorial illustration of an example fin having a beveled edge.

In one or more embodiments, the user may adjust the angle of first fin 108*a* and the second fin 108*b* to a desired angle before commencing with painting. Further, in some embodiments, the user may replace either of first fin 108*a* or the second fin 108*b* having a rectangular shape with another desired shape (e.g., circular, curved, triangular, or any other shape). In one embodiment, the user may further extend or retract a length of the elongated sheet 104 to a desired length. FIG. 8 depicts an example fin 108 having a curved edge 802. FIG. 9 depicts an example fin 108 having a beveled edge 902.

One of the main advantages of the paint shield 102 is the sheer amount of time that the painter can save by using a paint shield 102 such as the ones described above in one or more non-limiting embodiments. The paint shield 102 has been shown to save on average 10 hours or more of corrective painting after initial coats of paint have been deposited on an intended painting surface to correct the areas where overspray occurs as well as the amount of time needed to prepare before painting by either taping off sections of a surface or covering with cloth or other material. This average amount of hours saved by the painter directly translates to cheaper costs for the client who does not have to pay for so much time to go back and paint over any overspray and fix the areas having excess paint or overspray.

Figure 6:
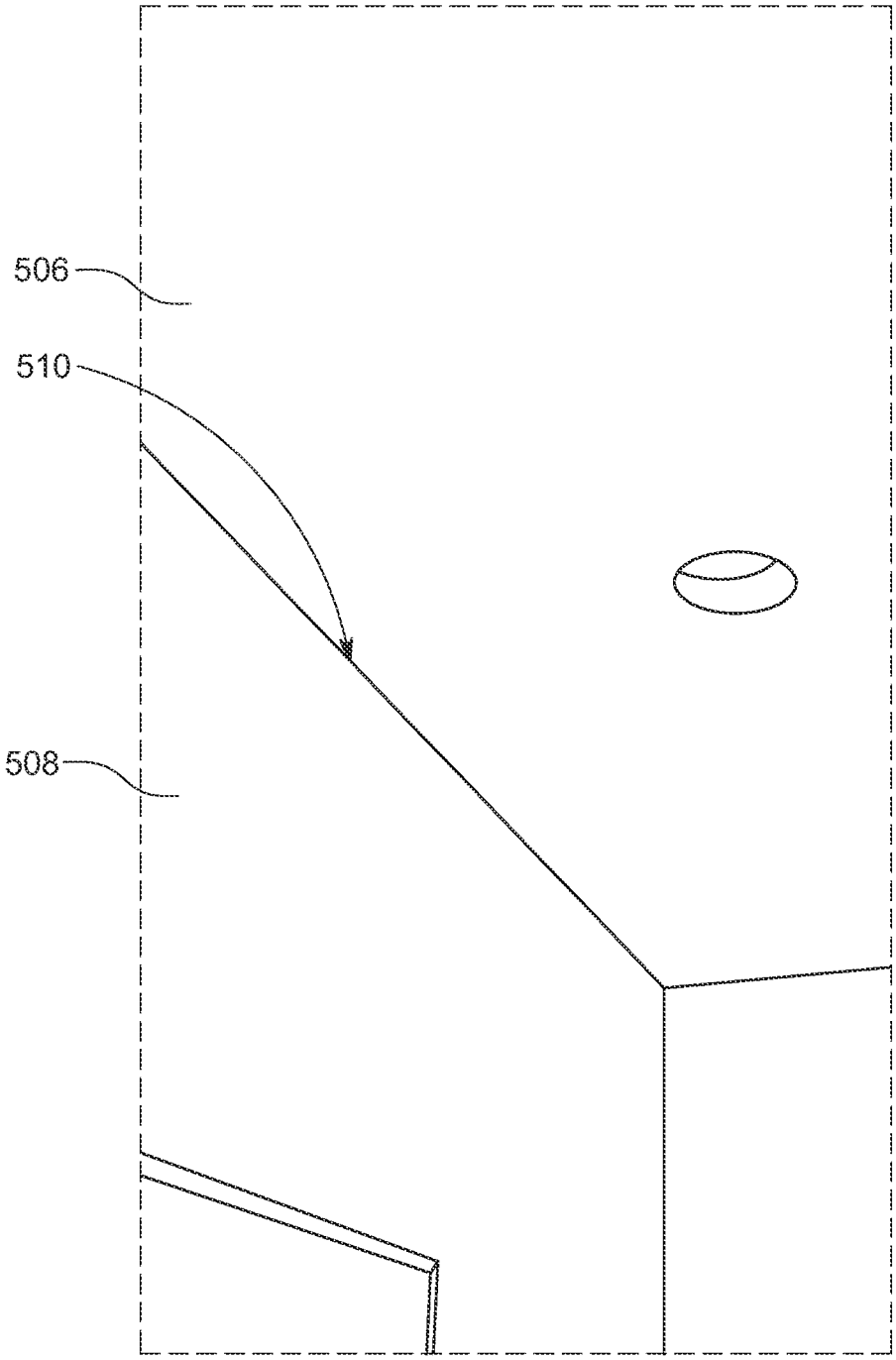
FIG. 6 is a pictorial illustration depicting a finished room with a view of the intersection of the ceiling and wall surfaces upon completing of painting using the paint shield.

FIG. 6 illustrates the clean lines that are produced from using the paint shield 102 along a joint 510 between the ceiling 506 and a wall 508. The area that is protected by the paint shield 102, in this case the ceiling 506, will be clear of paint that is a different color or type than what the user desires. Accordingly, the wall 508 in this instance as shown in FIG. 6 may be imagined to have a different color paint than the ceiling 506, which is achieved over a much faster period of time due to the user of the painting tool (e.g., paint sprayer 520) and the paint shield 102 as shown. The joint 510 between the ceiling 506 and the wall 508 is the separator between the painted area of the wall 508 and the ceiling 506, which may be a clear demarcation of the different colors/types of paint used.

Figure 7:
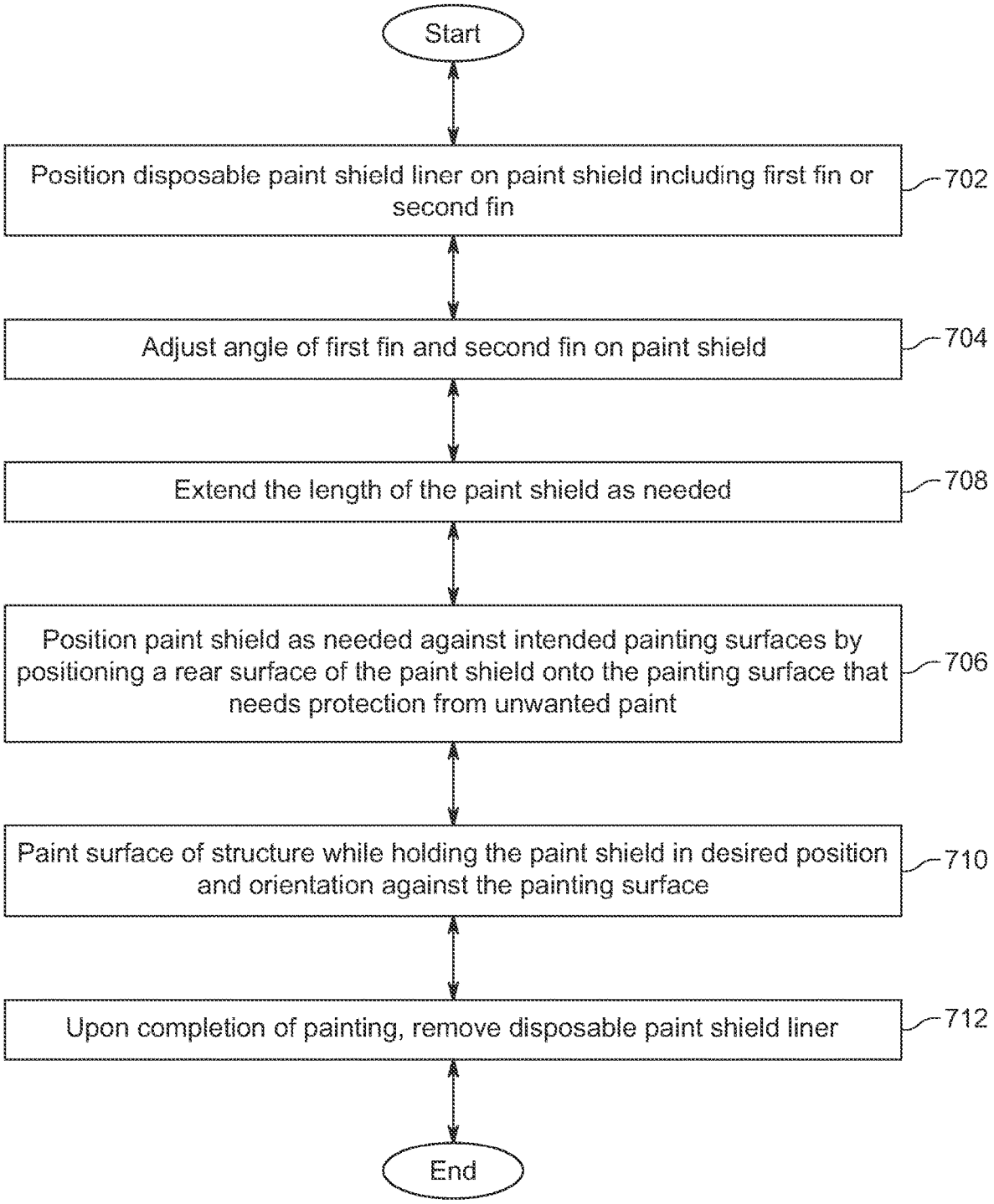
FIG. 7 is a flowchart of an exemplary method of use of the paint shield.

FIG. 7 shows a flowchart of an exemplary method for using paint shield 102. At step 702, the method may begin, in one or more non-limiting embodiments, by positioning or placing a disposable paint shield liner on the front surface 246 of the paint shield 102 including a first fin 108*a* or second fin 108*b*. At step 704, the user may adjust the angle of the first fin 108*a* and the second fin 108*b*. At step 706, the paint shield length may be extended to a desired length if the paint shield body is configured to extend in a longitudinal direction across the longest part of the planar sheet 104 of the paint shield 102 between the first fin 108*a* and the second fin 108*b* to be longer or shorter. In some embodiments, the width 102 of paint shield (e.g., between the top edge 220 and the bottom edge 222 of the planar sheet 104) may also be adjustable to be wider or narrower over a range of widths. The user may replace the existing fins 108 with a larger size fin on the left and right side to accommodate the wider width of the elongated planar sheet 104 in one non-limiting embodiment.

At step 708, the method may continue with positioning the paint shield 102 as needed against an intended painting surface by positioning a rear surface 448 of the paint shield 102 onto the painting surface. In some embodiments, it may be desirable to have the first fin 108*a* and the second fin 108*b* be positioned at a right angle with respect to the elongated sheet 104. In other embodiments, it may be desirable for the angle of the first fin 108*a* and the second fin 108*b* to be adjusted to either an acute angle or an obtuse angle or even a straight angle in order to best protect a surface from receiving overspray.

At step 710, the method may continue with painting a surface of a structure while holding the paint shield 102 in a desired position and orientation against the painting surface. The user may move the paint shield 102 right or left or up or down as needed while painting a surface in order to protect certain areas of the structure from receiving overspray. Further, the user may hold the paint shield 102 in either a vertical or horizontal orientation while the front surface 246 of the paint shield 102 is facing the user. At step 712, upon completion of the painting, if a disposable paint shield liner 110 or cover was used, the disposable paint shield liner 110 or cover may be removed from the paint shield 102. The steps of the exemplary method as included above do not have to be performed in the exact same order as listed and can be rearranged as needed.

The paint shield 102 as described in one or more non-limiting embodiments provides many advantages and benefits. As noted above, in many cases, the paint shield 102 with the at least two reinforcing ridges 106*a*, 106*b* may lay straighter and closer to a surface to be protected when compared with other paint shields having a single ridge. Further, the addition of the fins 108*a*, 108*b* enables any overspray to be directed to the fins 108*a*, 108*b* and to protect the surfaces on either side of the paint shield 102 as well as any surface directly below the paint shield 102. In one or more non-limiting embodiments, the fins 108*a*, 108*b* may be replaceable and detachable and provided for in a variety of shapes and designs. Further, a disposable or non-disposable paint liner 110 may be used to protect the paint shield 102 from paint so that the user can reuse the paint shield 102 regularly without waiting to clean any paint off of the paint shield 102 or wait for the paint on the paint shield 102 to dry. Advantageously, the user saves multiple hours (e.g., 10 hours or more) of time needed to paint over any overspray or excess paint and preparation work prior to commencing painting. One of ordinary skill may envision other advantages and benefits that are within the scope of the present description.

The methods, systems, and devices discussed above are examples. Various embodiments may omit, substitute, or add various procedures or components as appropriate. For instance, in alternative configurations, the methods described may be performed in an order different from that described, and/or various stages may be added, omitted, and/or combined. Also, features described with respect to certain embodiments may be combined in various other embodiments. Different aspects and elements of the embodiments may be combined in a similar manner. Also, technology evolves and, thus, many of the elements are examples that do not limit the scope of the disclosure to those specific examples.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A paint shield, comprising:

a single elongated planar sheet, the single elongated planar sheet having a top edge, a bottom edge, a left side edge, and a right side edge, the single elongated planar sheet further comprising:

at least two reinforcing ridges comprising a first reinforcing ridge and a second reinforcing ridge, wherein the at least two reinforcing ridges extend in a longitudinal direction along the single elongated planar sheet, wherein the at least two reinforcing ridges are spaced apart from one another, and further wherein the first reinforcing ridge is spaced a first distance below the top edge of the single elongated planar sheet and the second reinforcing ridge is spaced a second distance above the bottom edge of the single elongated planar sheet, wherein the first reinforcing ridge and the second reinforcing ridge are both located on the single elongated planar sheet;

a first fin attached to the left side edge of the single elongated planar sheet, wherein the first fin is removably attached to the left side edge of the single elongated planar sheet with at least one first fin fastener, wherein the first fin is configured to be attached and detached using the at least one first fin fastener, wherein the at least one first fastener extends through a part of the first fin and into the single elongated planar sheet; and a second fin attached to the right side edge of the single elongated planar sheet, wherein the second fin is removably attached to the right side edge of the single elongated planar sheet with at least one second fin fastener, wherein the second fin is configured to be attached and detached using the at least one second fin fastener, wherein the at least one second fin fastener extends through a part of the second fin and into the single elongated planar sheet, wherein an angle of the first fin with respect to the left side edge and an angle of the second fin with respect to the right side edge is alterable and adjustable over a range of angles comprising acute angles, right angles, obtuse angles, and a straight angle.

2. The paint shield of claim 1, wherein when the angle of the first fin and the angle of the second fin are positioned at the straight angle, the first fin and the second fin are flat and level with the single elongated planar sheet thereby extending an overall length of the paint shield.

3. The paint shield of claim 1, wherein a length of the single elongated planar sheet is extendable such that segments of the single elongated planar sheet are extendable in a longitudinal direction.

4. The paint shield of claim 1, wherein the first fin and the second fin are separately detachable and replaceable with other fins.

5. The paint shield of claim 4, wherein the other fins comprise curved or beveled edges.

6. The paint shield of claim 1, further comprising a handle attachment piece positioned along the bottom edge of the single elongated planar sheet.

7. The paint shield of claim 6, wherein the handle attachment piece is configured to connect to a handle.

8. The paint shield of claim 7, wherein the handle is configured to pivot around a pivot point while attached to the single elongated planar sheet in order to enable the handle to be rotatable.

9. A paint shield, comprising:

a single elongated planar sheet, the single elongated planar sheet having a top edge, a bottom edge, a left side edge, and a right side edge, the single elongated planar sheet further comprising:

at least two reinforcing ridges comprising a first reinforcing ridge and a second reinforcing ridge, wherein the at least two reinforcing ridges extend in a longitudinal direction along the single elongated planar sheet, wherein the at least two reinforcing ridges are spaced apart from one another, and further wherein the first reinforcing ridge is spaced a first distance below the top edge of the single elongated planar sheet and the second reinforcing ridge is spaced a second distance above the bottom edge of the single elongated planar sheet, wherein the first reinforcing ridge and the second reinforcing ridge are both located on the single elongated planar sheet;

a first fin attached to the left side edge of the single elongated planar sheet, wherein the first fin is removably attached to the left side edge of the single elongated planar sheet with at least one first fin fastener, wherein the first fin is configured to be attached and detached using the at least one first fin fastener, wherein the at least one first fastener for the first fin extends through a part of the first fin and into the single elongated planar sheet; and a second fin attached to the right side edge of the single elongated planar sheet, wherein the second fin is removably attached to the right side edge of the single elongated planar sheet with at least one second fin fastener, wherein the second fin is configured to be attached and detached using the at least one second fin fastener, wherein the at least one second fin fastener for the second fin extends through a part of the second fin and into the single elongated planar sheet, wherein an angle of the first fin with respect to the left side edge and an angle of the second fin with respect to the right side edge is alterable and adjustable over a range of angles comprising acute angles, right angles, obtuse angles, and a straight angle; and one or more pieces of a disposable paint shield liner that is configured to be removably attached to a top surface of the single elongated planar sheet and/or also to a top surface of the first fin and to a top surface of the second fin.

10. The paint shield of claim 9, wherein the one or more pieces of the disposable paint shield liner covers at least a full length of the single elongated planar sheet, and/or also covers the top surface of the first fin and the top surface of the second fin.

11. A method of protecting a surface from paint, comprising:

positioning a paint shield over the surface to be protected from the paint, the paint shield comprising a single elongated planar sheet, at least two reinforcing ridges comprising a first reinforcing ridge and a second reinforcing ridge, a left fin, and a right fin, wherein the left fin and the right fin are adjustable over a range of angles with respect to the single elongated planar sheet, wherein the first reinforcing ridge and the second reinforcing ridge extend in a longitudinal direction along the single elongated planar sheet, wherein first reinforcing ridge and the second reinforcing ridge are spaced apart from one another, and further wherein the first reinforcing ridge is spaced a first distance below the top edge of the single elongated planar sheet and the second reinforcing ridge is spaced a second distance above the bottom edge of the single elongated planar sheet, wherein the first reinforcing ridge and the second reinforcing ridge are both located on the single elongated planar sheet;

wherein the left fin is removably attached to a left side edge of the single elongated planar sheet with at least one first fin fastener, wherein the left fin is configured to be attached and detached using the at least one first fin fastener, wherein the at least one first fin fastener extends through a part of the left fin and into the single elongated planar sheet, wherein the right fin is removably attached to a right side edge of the single elongated planar sheet with at least one second fin fastener, wherein the right fin is configured to be attached and detached using the at least one second fin fastener, wherein the at least one second fin fastener extends through a part of the right fin and into the single elongated planar sheet;

positioning the left fin of the paint shield to a first desired angle;

positioning the right fin of the paint shield to a second desired angle;

placing a back surface of the paint shield against the surface to be protected, wherein any underlying area covered by the paint shield including any underlying area beneath or behind the left fin and the right fin is protected from the paint;

painting an unprotected surface around or near the paint shield up to an outer facing edge of the left fin and an outer facing edge of the right fin; and removing the paint shield from the surface to be protected after painting of the unprotected surface is complete.

12. The method of claim 11, further comprising, detaching the left fin and the right fin from the single elongated planar sheet by removing the at least first fin fastener and by removing the at least second fin fastener.

13. The method of claim 11, wherein the paint shield comprises a handle attachment mechanism.

14. The method of claim 11, further comprising attaching a handle to the handle attachment mechanism.

15. The method of claim 11, wherein placing the back surface edge of the paint shield against the surface to be protected, further comprises:

while holding a handle of the paint shield, turning the paint shield so that the back surface of the paint shield is facing the surface to be protected; and placing the back surface of the paint shield against the surface to be protected while holding the handle of the paint shield.

16. The method of claim 11, further comprising extending a length of the single elongated planar sheet on the paint shield as needed to cover the surface to be protected, wherein a body of the single elongated planar sheet is extendable and retractable.

17. The method of claim 11, further comprising, prior to painting the surface to be protected, attaching a removeable liner to the single elongated planar sheet and/or the left fin and the right fin.

* * * * *